US008104125B2

(12) United States Patent
Soltani et al.

(10) Patent No.: US 8,104,125 B2
(45) Date of Patent: Jan. 31, 2012

(54) SELF-CONTAINED GATCHING, ROTATING AND ADJUSTABLE FOOT SECTION MATTRESS

(75) Inventors: Sohrab Soltani, Charleston, SC (US); Joel T. Jusiak, Holland, NY (US); Karl H. Cazzini, Lindenhurst, IL (US)

(73) Assignee: Stryker Corporation, Kalamazoo, MI (US)

( * ) Notice: Subject to any disclaimer, the term of this patent is extended or adjusted under 35 U.S.C. 154(b) by 594 days.

(21) Appl. No.: 12/247,765

(22) Filed: Oct. 8, 2008

(65) Prior Publication Data

US 2009/0106906 A1 Apr. 30, 2009

Related U.S. Application Data

(60) Provisional application No. 60/984,191, filed on Oct. 31, 2007.

(51) Int. Cl.
*A47C 27/08* (2006.01)
*A47C 17/00* (2006.01)

(52) U.S. Cl. ..... 5/706; 5/722; 5/713; 5/690

(58) Field of Classification Search ..... 5/706, 713, 5/715, 731, 734, 722, 661
See application file for complete search history.

(56) References Cited

U.S. PATENT DOCUMENTS

| | | | | |
|---|---|---|---|---|
| 5,542,136 | A | 8/1996 | Tappel et al. | |
| 5,794,289 | A | 8/1998 | Wortman et al. | |
| 5,926,883 | A | 7/1999 | Rechin et al. | |
| 6,208,250 | B1 | 3/2001 | Dixon et al. | |
| 7,216,384 | B2 | 5/2007 | Allen et al. | |
| 7,253,366 | B2 | 8/2007 | Bhai | |
| 2007/0235036 | A1 * | 10/2007 | Bobey et al. | 128/845 |

* cited by examiner

*Primary Examiner* — Jonathan Liu
(74) *Attorney, Agent, or Firm* — Warner Norcross & Judd LLP

(57) ABSTRACT

A self-contained gatching mattress is provided having a gatching mattress sleep deck, a first air bladder cushion, a second cushion material, a control box having an air pump system and a manifold, a conduit distribution unit, a sliding bridge, and a cushion material positioned above the sliding bridge and the control box. The sliding bridge forms a gap area for conduits to extend from the control box to the conduit distribution unit which decreases the chances of the conduits being kinked or the conduits altering the cushion's tissue interface pressure to a patient positioned on the cushion when the sleep deck is gatched and/or portions are retracted or extended.

15 Claims, 6 Drawing Sheets

SELF-CONTAINED GATCHING, ROTATING AND ADJUSTABLE FOOT SECTION MATTRESS

CLAIM OF PRIORITY

This application claims priority to U.S. provisional application Ser. No. 60/984,191; filed on Oct. 31, 2007.

FIELD OF THE INVENTION

The present invention is directed to a self-contained gatching, rotating, and/or adjustable foot section mattress, and in particular for a contoured mattress sleep deck.

The present invention is directed to a mattress system that decreases tissue interface pressure and vibration to the patient. To understand the improvements in the mattress embodiment, we need to detail one prior art mattress configuration and the location of the devices used to operate the mattress.

The contoured and adjustably positionable mattress sleep deck 10 is divided into a head section 12, a seat section 14 and a foot section 16 as shown in FIG. 1.

Head Section

The head section 12 has a head end 121, a head/seat end 122, a torso base area 123, a manifold area 124, a left head wall 126 (in relation to a patient being supine with their head at the head end) and a right head wall 128. Starting from the head/seat end 122, the torso base area 123 extends toward the head end 121 until it reaches the manifold area 124. The manifold area 124 is approximately 2 inches above the base area 123.

The left head wall 126 extends from the base area 123 and the manifold area 124 at an obtuse angle relative to the left side of the base area 123 and the manifold area 124. Likewise, the right head wall 128 extends from the base area 123 and the manifold area 124 at the obtuse angle relative to the right side of the base area 123 and the manifold area 124. The left wall 126 and the right wall 128 extend to about 4 to 5 inches above the base area 123.

At the top of the left head wall 126 and the right head wall 128 is a ledge 129 protruding away from the base area 124.

The torso base area 123, the manifold area 124, the left head wall 126 and the right head wall 128 define a head cavity 132. The head cavity 132 contains a plurality of cushion materials, which will be described below.

Seat Section

The seat section 14 has a seat/head end 141, a seat/foot end 142, a seat base area 143, a left seat wall 146 and a right seat wall 148. Starting from the seat/foot end 142, the seat base area 143 extends to the seat/head end 141.

The left seat wall 146 extends from the base area 143 at the obtuse angle relative to the left side of the base area 143. Likewise, the right seat wall 148 extends from the base area 143 at the obtuse angle relative to the right side of the base area 143. The left seat wall 146 and the right seat wall 148 extend to about 4 to 5 inches above the base area 143.

Foot Section

The foot section 16 has a foot/seat end 161, a foot end 162, a foot base area 163, a left foot wall 166 and a right foot wall 168. Starting from the foot end 162, foot base area 163 extends toward the foot/seat end 161.

The left foot wall 166 extends from the base area 163 at the obtuse angle relative to the left side of the base area 163. Likewise, the right foot wall 168 extends from the base area 163 at the obtuse angle relative to the right side of the base area 163. The left foot wall 166 and the right foot wall 168 extend to about 4 to 5 inches above the base area 163.

As identified above, the foot section 16 may be moved between a retracted position and an extended position. In the retracted position a portion of the foot section 16 is positioned under the seat section 14.

Location of Cushions, Manifold, and Pumps

The manifold area 124 contains a conventional manifold 200. The manifold 200 has an inlet (not shown) that receives air through a first conduit from a conventional air compressor (or air pump). Within the manifold, the manifold has numerous valves and equivalents thereof and an electronic system that monitors which valves should be open and closed at particular times. The control of those valves and equivalents thereof are well known to those skilled in the art. The air released through the valves is directed toward a manifold outlet. Attached to the manifold outlet are second conduits that distribute air to the respective air cushions used in the head section 12, the seat section 14, and the foot section 16.

Along the left side 126, 146, 166 is a left crib 170*a* and along the right side 128,148,168 is a right crib 170*b* as shown in FIG. 2. The cribs 170*a, b* define a left and right side perimeter of (a) a first air cushion area 252 for air cushion(s) 250*a* in the head section 12, except the manifold area 124 which has a second cushion material thereon, air cushion(s) 250*b* in the seat section 14, and (c) a second air cushion area 254 for air cushion(s) 250*c* in the foot section 16. The crib material in the foot area 16 is a conventional compressible foam material while the other areas can be compressible foam material or not.

Air cushions 250*a, b, c* are positioned in the first and second air cushion areas 252, 254 respectively. The air cushions 250*a, b* in the first air cushion area 252 can contain a third cushion material. The third cushion material, foam, is positioned in air cushions 250*a, b* to inhibit the patient from bottoming out on the base layers 123, 143 in case the air in the air cushions was released. Air cushions 250 do not extend from the foot end 162 to the foot/seat end 161 of the foot section 16. A compressible cushion 260 is positioned between the air cushion(s) 250*c* in the foot section 16 and the air cushion(s) 250*b* positioned in the seat area 14.

The compressible foam cushion 260 is a conventional foam material having apertures therein or a serpentine shape illustrated in U.S. Pat. No. 7,216,384 so the foot area 16 can be retracted and/or extended without increasing the tissue interface pressure to the patient positioned thereon. Notice the compressible foam cushion 260 is the height of the air cushions 250*a, b, c*.

Positioned below the head area 12 is an air compressor 270 as shown in FIG. 1 (dotted lines) which is connected to an underlying frame not the sleep deck 10. The air compressor 270 draws air into the compressor and from the compressor the air travels through a conduit to the manifold 200. As previously implied, the manifold 200 does not always distribute air evenly to each air bladder(s) 250*a, b, c*. Instead the manifold 200 distributes air to an individual air bladder or a specific group of air bladders to provide the desired pressure to particular areas positioned below the patient as controlled by a conventional circuitry system that is well known to those skilled in the art and is disclosed in U.S. Pat. Nos. 7,253,366 and 6,208,250, which are hereby incorporated by reference.

Positioned below the air cushions 250 in the first air cushion area 252 and above the contoured mattress sleep deck 10 are rotating bladders 300. The rotating bladders 300 are also interconnected to the manifold 200 in the same manner as the air bladders 250*a, b, c*. Rotating a patient on an inflatable mattress is well known to those of ordinary skill in the art.

Rotating a patient is one method to avoid and/or decrease the formation of bed sores on immobile patients. A rotatable inflatable mattress and the method in which the mattress rotates the patient are disclosed in U.S. Pat. Nos. 5,794,289 and 5,926,883 which are commonly assigned and are hereby incorporated by reference.

Rotation Fulcrum Point

The fulcrum point for a conventional rotating bladder and its overlying cushion material is at the overlying cushion's edge at the side that is not lifting ("rotating") the patient. The fulcrum at the cushion's edge is undesirable because it promotes a patient to (a) fall off the mattress when a crib is not used and/or (b) be positioned against the crib when a crib is used which can increase the patient's tissue interface pressure.

Prior Self-Contained Mattress Systems

In U.S. Pat. No. 5,542,136, Tappel discloses a non-gatching self-contained mattress. A non-gatching mattress remains in a single plane, and has no notches in the mattress (as present in gatching mattresses) that can kink hoses that protrude from one end of the bed to the other. Tappel also discloses a single manifold and valve system interconnected to an air compressing device in the foot section of the mattress and no where else in the mattress.

Kinking inhibits air from freely flowing into the air bladders. That is undesirable because kinking affects (in many cases adversely) the tissue interface pressure applied to the patient through the air bladders and/or the compressible foam material.

In relation to the compressible foam bladders, if the conduits protruding from the manifold are positioned under and/or adjacent to the compressible foam, then when the foot area is compressed the conduits will move. The moving conduits could alter the shape of the compressible foam in a non-linear (non-accordion) manner (for example, the moved conduit could push the compressible foam toward the patient). Non-linear movement of the compressible foam could result in increased pressure being applied to the patient through the compressible foam. Again that is undesirable.

For definitional purposes, self-contained means the air compressor (or pump) along with cushions are positioned within a conventional mattress cover. Such self-contained mattresses are easy to clean, easy to set up, and easy to adapt for other uses. As such a self-contained mattress system capable of gatching and/or having the foot end retract and/or extend is desired.

SUMMARY OF THE INVENTION

A self-contained gatching mattress having a gatching mattress sleep deck, a first air bladder cushion, a second cushion material, a control box having an air pump system and a manifold, a conduit distribution unit, a sliding bridge, and a cushion material positioned above the sliding bridge and the control box is provided. The sliding bridge forms a gap area for conduits to extend from the control box to the conduit distribution unit which decreases the chances of the conduits being kinked or the conduits altering the cushion's tissue interface pressure to a patient positioned on the cushion when the sleep deck is gatched and/or portions are retracted or extended.

DETAILED DESCRIPTION OF THE INVENTION

The present invention utilizes the contoured and adjustably positionable mattress sleep deck 10 that is identified above, conventional planar gatching sleep decks, conventional planar sleep decks having retracting and/or extracting foot sections, or combinations thereof.

The current invention is not a wholesale change of the mattress or the sleep deck 10 used in the prior art. Instead, the invention is directed toward changes in (A) the mattress that (1) decrease (a) tissue interface pressure, and (b) excess vibration applied to the patient, (2) alters the rotation therapy fulcrum point to decrease the chance a patient will fall out of the bed and/or be caught between the frame's guard rails and the mattress, and/or (3) has a self-contained mattress system that can gatch and/or have the foot end extend and/or retract, and/or (B) the contoured sleep deck 10 to make it usable on other operational frames—non-movable operational frames or other gatching operational frames.

Figure 1:
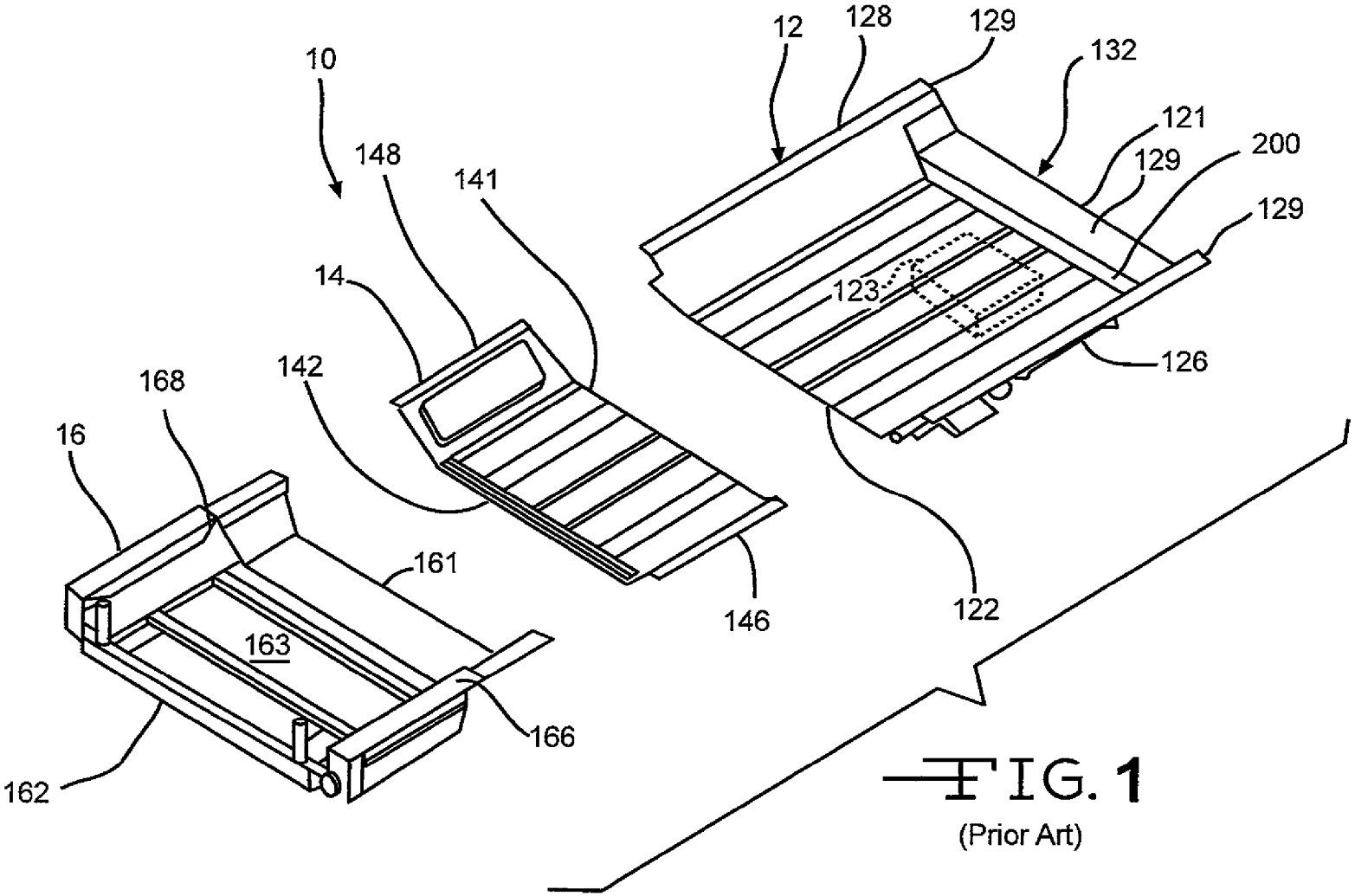
FIG. 1 (Prior Art)
FIG. 1 is an exploded view of a conventional gatching contoured sleep deck that illustrates the location of an air pump (compressor) in relation to the sleep deck positioned below the sleep deck and attached to another frame.
Figure 2:
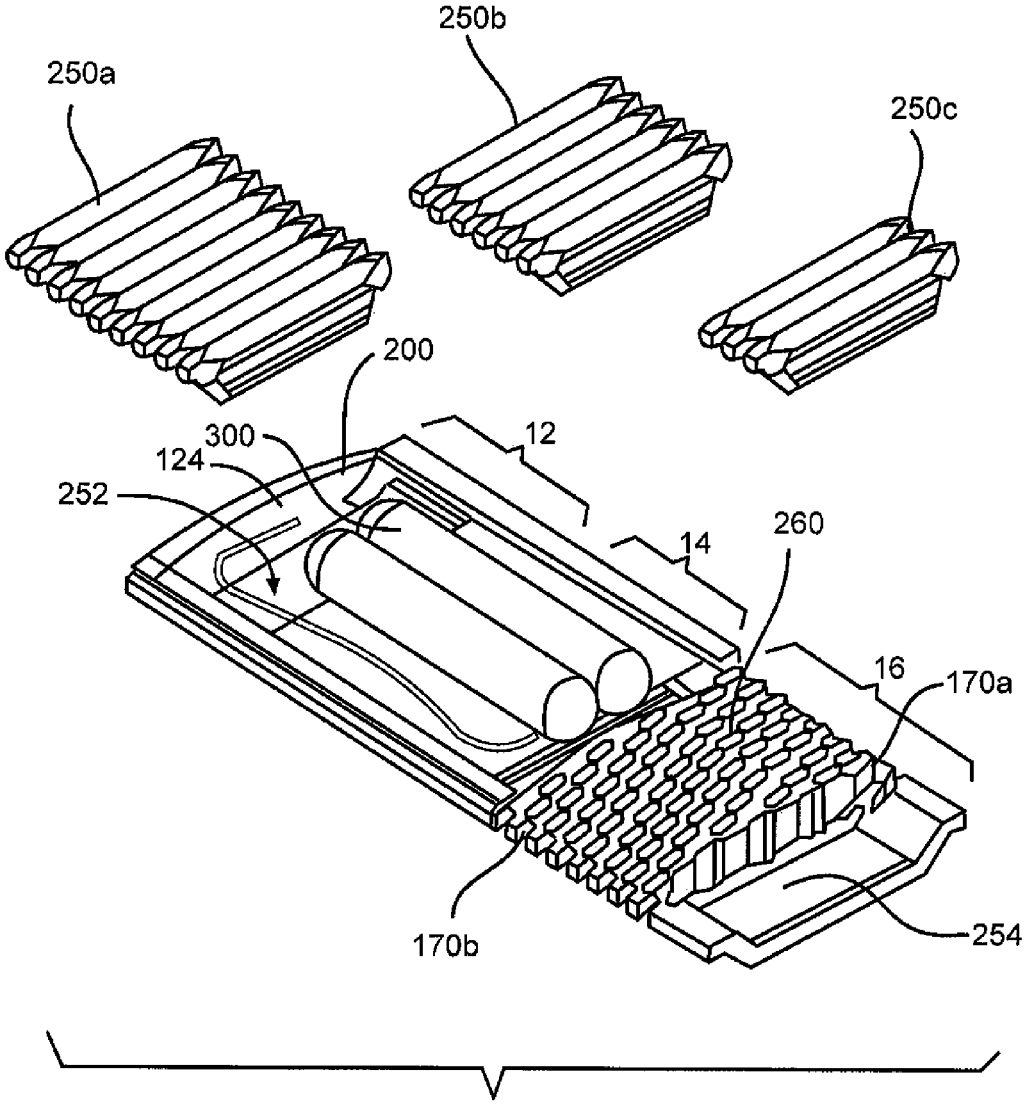
FIG. 2 (Prior Art)
FIG. 2 is an exploded view of mattress materials used on a conventional contoured sleep deck.
Figure 3:
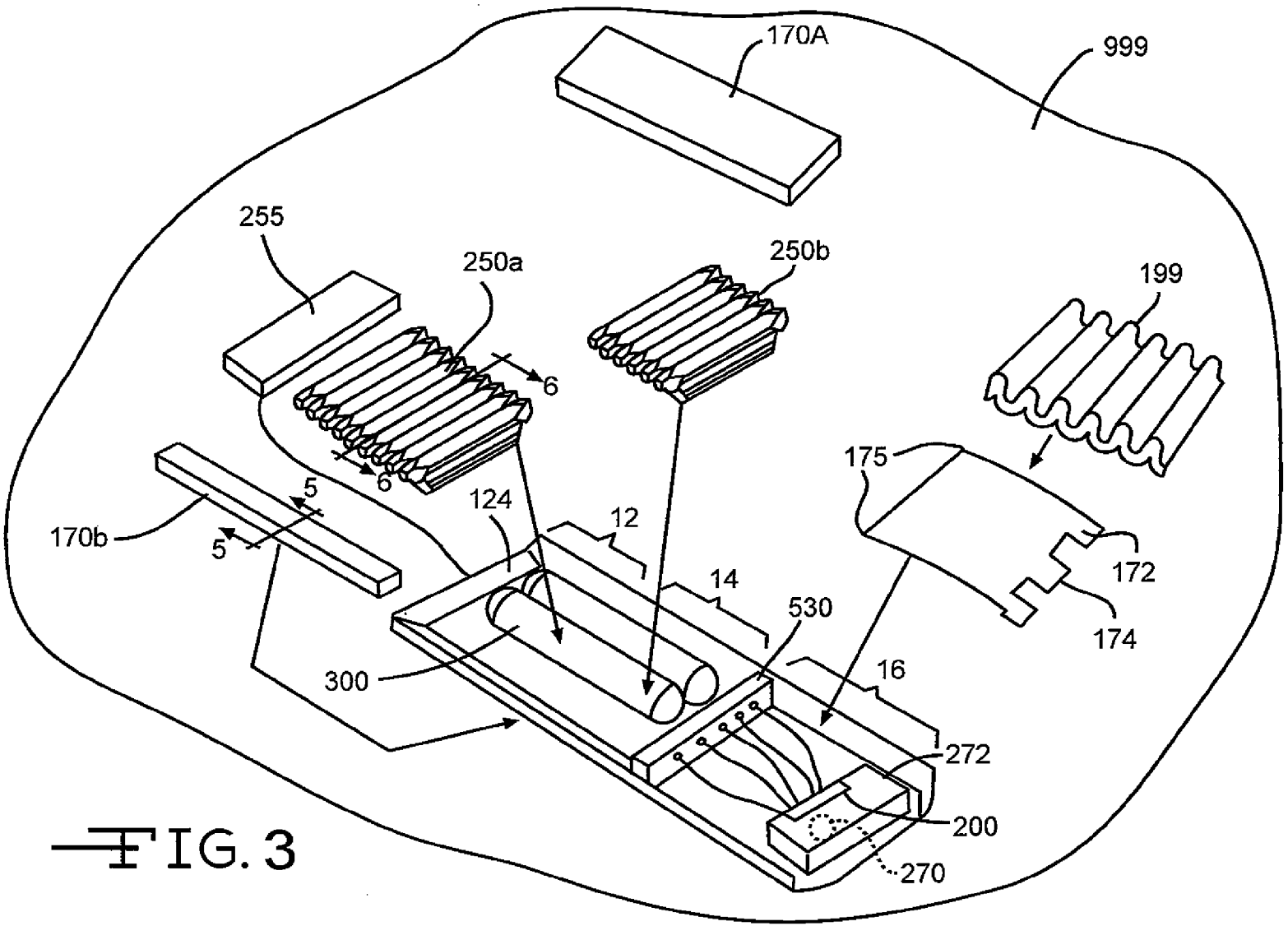
FIG. 3 is an exploded view of mattress materials on a gatching sleep deck having an air pump system, a manifold system and bridge system.

The self-contained mattress 1 will continue to have (a) air cushions 250 in the first air cushion area 252, (b) foam cushions on the left and right sides of the air cushions 250 in the first air cushion area 252 and (c) a second cushion material 255 over the manifold area 124 as shown in FIG. 3. The second cushion material is for example and not limited to foam, air cushion (obviously having less height than the air cushions 250), a gelastic cushion or a plurality of gelastic cushions made of tri-block copolymeric compositions, and combinations thereof. One example of a second cushion material is described in U.S. Pat. No. 7,060,213.

Decrease Tissue Interface Pressure and Vibration; and a Self-Contained Mattress System To decrease the vibration applied to the patient, the air compressor 270 and the manifold 200 are moved into a control chamber 272 positioned at the foot end 162 of the foot area 16. The control chamber 272 is a container having conventional air inlets to allow the air compressor to pull air into the compressor 270. The air compressor 270 then moves the air into the manifold 200. The air is then directed into conduits interconnected to a specific air bladder and/or group of air bladders 250*a, b*.

Figure 4:
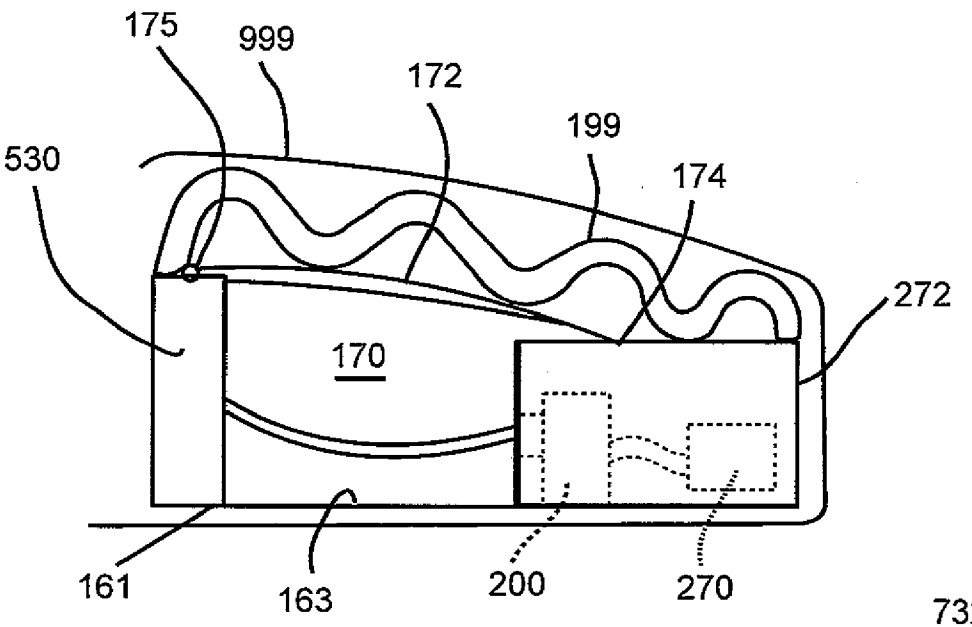
FIG. 4 is a cross-sectional view of FIG. 3 (non-exploded) taken from the lines 4-4.

A difference between the prior art and the current invention is a gap area 170 as best illustrated at FIG. 4 between the control chamber 272 and the foot/seat end 161. The gap area 170 is an area between (a) a sliding bridge 172 and the foot base area 163 and (b) the control chamber 272 and a conduit distribution unit 530.

The sliding bridge 172 has a distal end 174 and a proximal end 175. At the foot/seat end 161 or the seat/foot end 142 is a conduit distribution unit 530. The proximal end 175 is pivotally interconnected to an area around the conduit distribution unit 530 and may be on the conduit distribution unit 530. The distal end 174 is positioned on the control chamber 272. That way, when the foot area 16 extends or retracts, the sliding bridge 172 retains the gap area 170.

The gap area 170 is desirable because it provides room for the conduits in the gap area 170 to move around when the foot section is retracted or extended without altering the shape of the compressible material 199 positioned over (a) the sliding bridge 172 and (b) the control chamber 272. The compressible material 199 can be the compressible foam of the prior art or a gelastic cushion or a plurality of gelastic cushions made of tri-block copolymeric compositions. One example of a compressible material is described in U.S. Pat. No. 7,060,213.

The conduit distribution unit 530 is positioned to receive the conduits that extend from the control chamber 272 (manifold 200) and into the gap area 170. The conduit distribution unit 530 has a plurality of apertures. There is at least one aperture per conduit. By controlling the location of the conduit, the conduits are essentially limited to specific locations which in turn control where the conduits move in relation to other conduits in the area.

The conduit distribution unit 530 also inhibits the conduits from kinking at the juncture between the foot section 16 and the seat section 14. The kinking is inhibited because the conduit distribution unit's apertures are positioned above the surface of the base areas 163 and 143. The base areas 163, 143 create kinking and since the conduits are above those areas, the base areas 163, 143 have a decreased chance of kinking the conduits.

Figure 5:
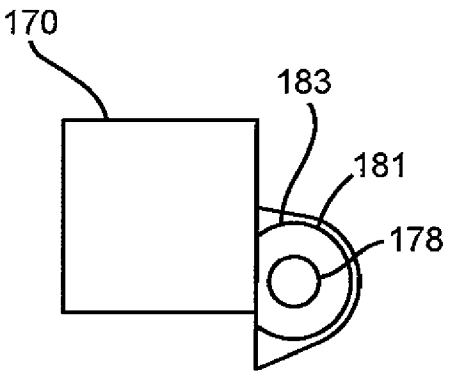
FIG. 5 is a cross-sectional view of FIG. 3 (non-exploded) taken from the lines 5-5.

Once the conduits (and electrical circuitry) are past the conduit distribution unit 530, the conduits are positioned against the crib material 170*a, b* of the seat section 14 and the head section 12. The conduits 178 are not just positioned against the crib material of the seat section 14 and the head section 12, as disclosed in the prior art. The conduits are also enclosed in fabric material 181 (like and not limited to a non-woven material) and a spring 183 is imbedded in, or attached to the fabric material's interior surface or exterior surface to retain a flexible conduit shape that will not increase the pressure to the patient, as shown in FIG. 5.

By (a) moving the manifold and the air compressor into the foot section between the foot base 163 and the compressible cushion 199 and (b) forming a gap area 170, the inventors have created a self-contained gatch mattress that can also have the foot section retract and extend.

The manifold area 124 now contains a conventional accelerometer (not shown) to measure the rotation and/or the gatching of the mattress. The accelerometer transmits its measurements to the controller for the manifold, which is in the prior art.

Rotation Bladders

If the rotating bladders are to be positioned between the base area(s) 123 (and/or 143) and the air cushions 250 (as illustrated in the prior art), then the rotating bladders have to be adjusted to move the fulcrum point of the rotating bladders from the exterior edge of the rotating bladders to a point that inhibits the patient from falling off the mattress or into the guide rails.

Positioning rotatable bladders below the support surface is contrary to the conventional method to rotate a patient. The conventional method rotates the patient through bladders positioned immediately below the patient (or immediately below an intermediary bladder).

Rotating Bladder

The rotating bladder 300 can comprise an upper inflatable bladder and a lower inflatable bladder. The bladders are divided into right bladders and left bladders. The foot end portions of the lower bladders can be tapered over about one-third of the length thereof to allow relatively greater lifting capacity for the head end and central portions supporting the torso of a patient since the torso requires greater lifting capacity than the feet. The upper bladder may be any suitable inflatable bladders and have button welds uniformly spaced thereover to prevent ballooning thereof when pressurized. Each lower bladder is absent button welds or the like so that it may desirably balloon when pressurized to lift the corresponding side of the cushion as needed.

Figure 6:
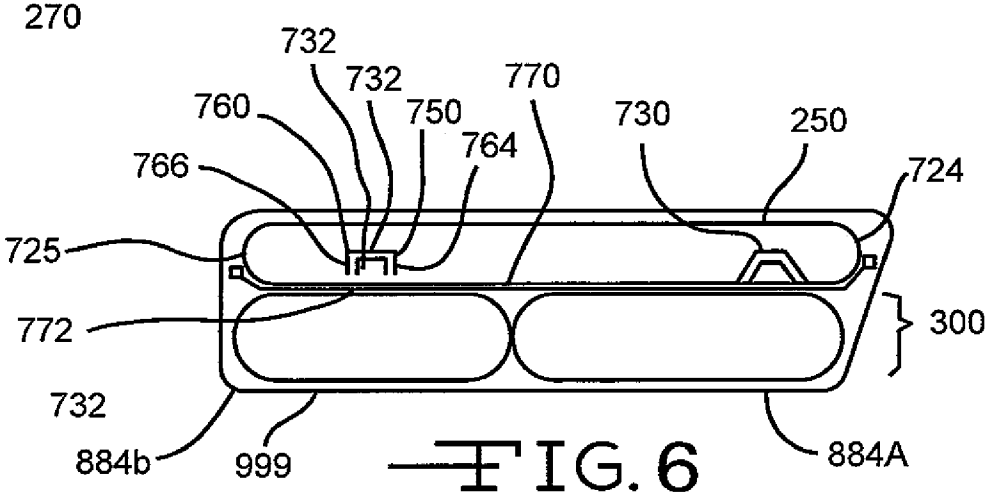
FIG. 6 is a cross-sectional view of FIG. 3 taken along the lines of 6-6 without cribbing material nor the sleep deck.
Figure 8:
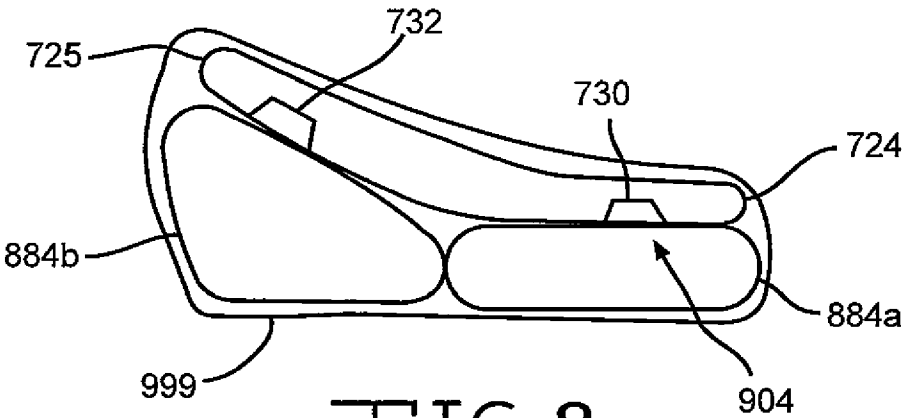
FIG. 8 is an alternative embodiment of FIG. 6 rotating to the right.
Figure 9:
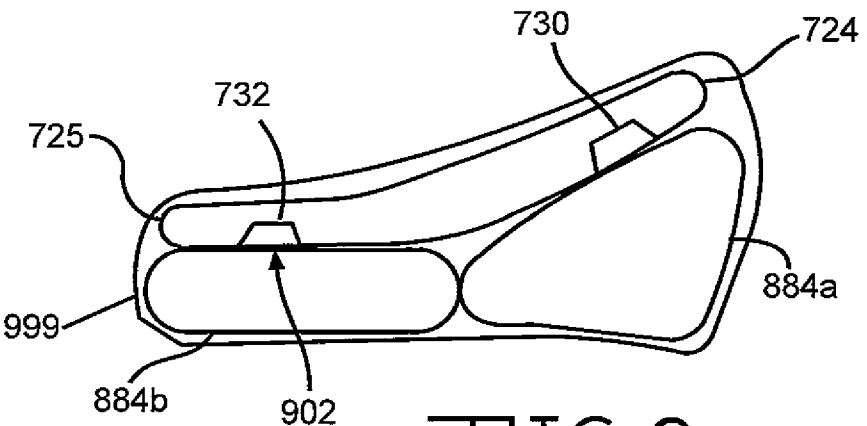
FIG. 9 is an alternative embodiment of FIG. 6 rotating to the left.
Figure 7:
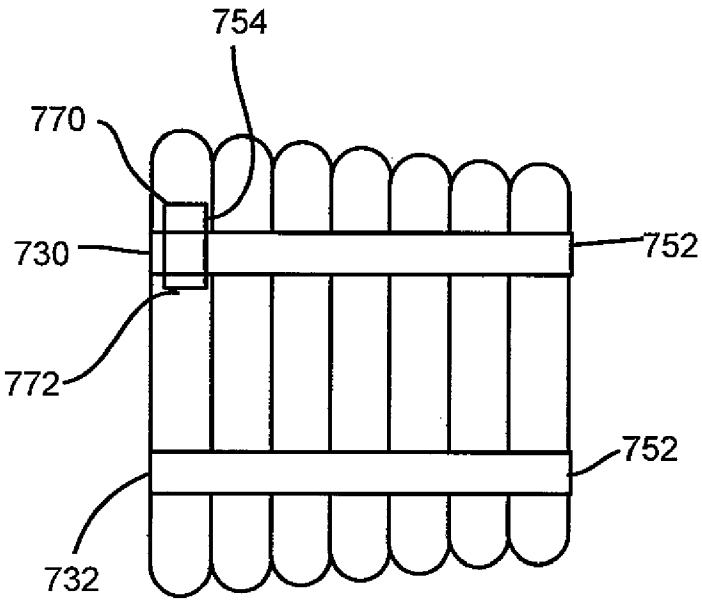
FIG. 7 is a view of FIG. 6 taken along the lines 7-7.

Alternatively, the rotational bladder 300 can just be the lower right bladder 884*a* and lower left bladder 884*b* as shown in FIGS. 6, 8, and 9. The lower right bladder 884*a* and lower left bladder 884*b* can be positioned below portions of the head section, the entire head section, portions of the seat section, the entire seat section, or combinations thereof.

Rotating Embodiment

In a first embodiment, the cushion material 250, as illustrated in FIG. 6, is positioned over the rotating bladder 300.

Cushion Material

The cushion material 250 has a right side edge 724 and a left side edge 725 (as seen in FIG. 6). The cushion material 250 has a first longitudinal hinge 730 and a second longitudinal hinge 732 as shown in FIGS. 6 to 9.

The first longitudinal hinge 730 (a) is positioned parallel to and near the right side edge 724 to inhibit the right side edge 724 from becoming the fulcrum point when the cushion material's left side is raised as illustrated in FIG. 8, and (b) extends from the head end 121 to a first predetermined point toward the seat/foot end 142. Preferably, the first longitudinal hinge 730 is positioned between 5 to 30 centimeters, preferably 10 to 20 centimeters, from the right side edge.

The first predetermined point toward the seat/foot end 142 can be the seat/foot end 142, in the seat section 14, at the head/seat section 122 or in the head section 12 and a predetermined distance away from the head end to inhibit the right side edge from becoming the fulcrum point when the cushion material's left side is raised.

The second longitudinal hinge 732 (a) is positioned parallel to and near the left side edge 725 to inhibit the left side edge 725 from becoming the fulcrum point when the cushion material's right side is raised as shown in FIG. 9, and (b) extends from the head end 121 to a second predetermined point toward the seat/foot end 142. Preferably, the second longitudinal hinge 732 is positioned between 5 to 30 centimeters, preferably 10 to 20 centimeters, from the left side edge.

The second predetermined point toward the seat/foot end 142 can be the seat/foot end 142, in the seat section 14, at the head/seat section 122, or in the head section 12 and a predetermined distance away from the head end to inhibit the left side edge from becoming the fulcrum point when the cushion material's right side is raised.

The first predetermined point and the second predetermined point can be equivalent points on opposite sides of the cushion material 250*a, b*, or different points. Preferably, the first predetermined point and the second predetermined point are at equivalent points on opposite sides of the cushion material 250*a, b*.

Hinge Embodiments

The first and second longitudinal hinges 730, 732 are designed to decrease the shear forces applied to the patient when the cushion material 250*a, b* moves in a rotational method and/or a gatching method and/or move the fulcrum point toward the hinge area and away from the mattress' side.

To accomplish these objectives for the first and second longitudinal hinges 730, 732, each hinge has a shaped opening 750 in the cushion material 250*a* and/or *b*. The shaped opening 750 has a measurable length, a measurable width and a measurable height (which does not include a mere slit). Examples of the shaped opening include and are not limited to a triangular shape, a trapezoidal shape, and a squared (or rectangular) shape. Each shaped opening 750 has a top area 760, a first side 764, and a second side 766. The cushioned material 250*a, b* that is positioned adjacent to (a) the first side 764 is referred to as the first attachment area 770 and (b) the second side 766 is referred to as the second attachment area 772.

Within the shaped opening 750 is a fourth cushion material 752. The fourth cushion material 752 is less rigid than the cushion material 250*a, b*. Examples of the fourth cushion material include and are not limited to foam materials, gelastic materials, air bladders with low air loss apertures and equivalents thereof. Obviously, the fourth cushion material may be the same generic material as the cushion material 250*a, b* except the fourth cushion material is less rigid than the cushion material 250*a, b*.

The fourth cushion material 752 remains within the shaped opening 750 through adhesives and/or a bridge material 754 (an example includes and is not limited to a non-woven material) that is attached to the first attachment area 770 and the second attachment area 772. The bridge material 754 may also be attached to the fourth cushion material 752 that is in the same plane as the first attachment area 770 and the second attachment area 772 when the cushion material 250*a, b* is in a single plane.

The decrease in shear force is illustrated by comparing pressures applied to the cushions. When the fourth cushion material 752 becomes compressed, it does not completely compress so the cushion sides 764 and 766 contact each other. When the first side 764 and the second side 766 contact each other, the cushion material 250*a, b* inherently slides which increases shearing forces. Since the sides 764, 766 do not contact each other due to the fourth cushion 752, there is decreased shear forces applied to the patient.

Rotational Movement

FIG. 9 illustrates tilting the cushion 250 to about a 15 degree angle to one side by inflating the right side bladder 884*a* while deflating or maintaining the left side bladder 884*b* in the same position (as shown in FIG. 6). This lowers the left side of the cushion 250 and raises the right side thereof. Thereby the second longitudinal hinge 732 becomes the cushion's 250 left fulcrum point 902.

By moving the cushion's 250 left fulcrum point away from the left edge (as used in the prior art), the patient is inhibited from falling off the mattress.

FIG. 8 illustrates tilting of the cushion 250 from the position of FIG. 9 to about a 15 degree angle to the other side by deflating the right side bladder 884*a* and by inflating the left side bladder 884*b*. This lowers the right side of the cushion 880 and raises the left side thereof. Thereby the first longitudinal hinge 730 becomes the cushion's 250 right fulcrum point 904.

By moving the cushion's 250 right fulcrum point away from the right edge (as used in the prior art), the patient is inhibited from falling off the mattress.

The cushion 250 may of course be tilted to a higher angle than 15 degrees. For example, the cushion 250 may be tilted to an angle of perhaps about 45 degrees by further inflation of the corresponding lower bladder 884, allowing ballooning thereof so that it approaches a tubular shape.

Whatever hinge embodiment is used, the longitudinal hinges 30, 32 decrease the chance a patient will fall off the mattress by moving the rotating bladder's fulcrum point from the left and right side edges of the rotating bladder toward the longitudinal hinge. As you may recall, the longitudinal hinge is positioned a predetermined distance from the left and right side edges of the rotating bladder to accomplish this objective.

Alternative Longitudinal Hinge

Figure 10:
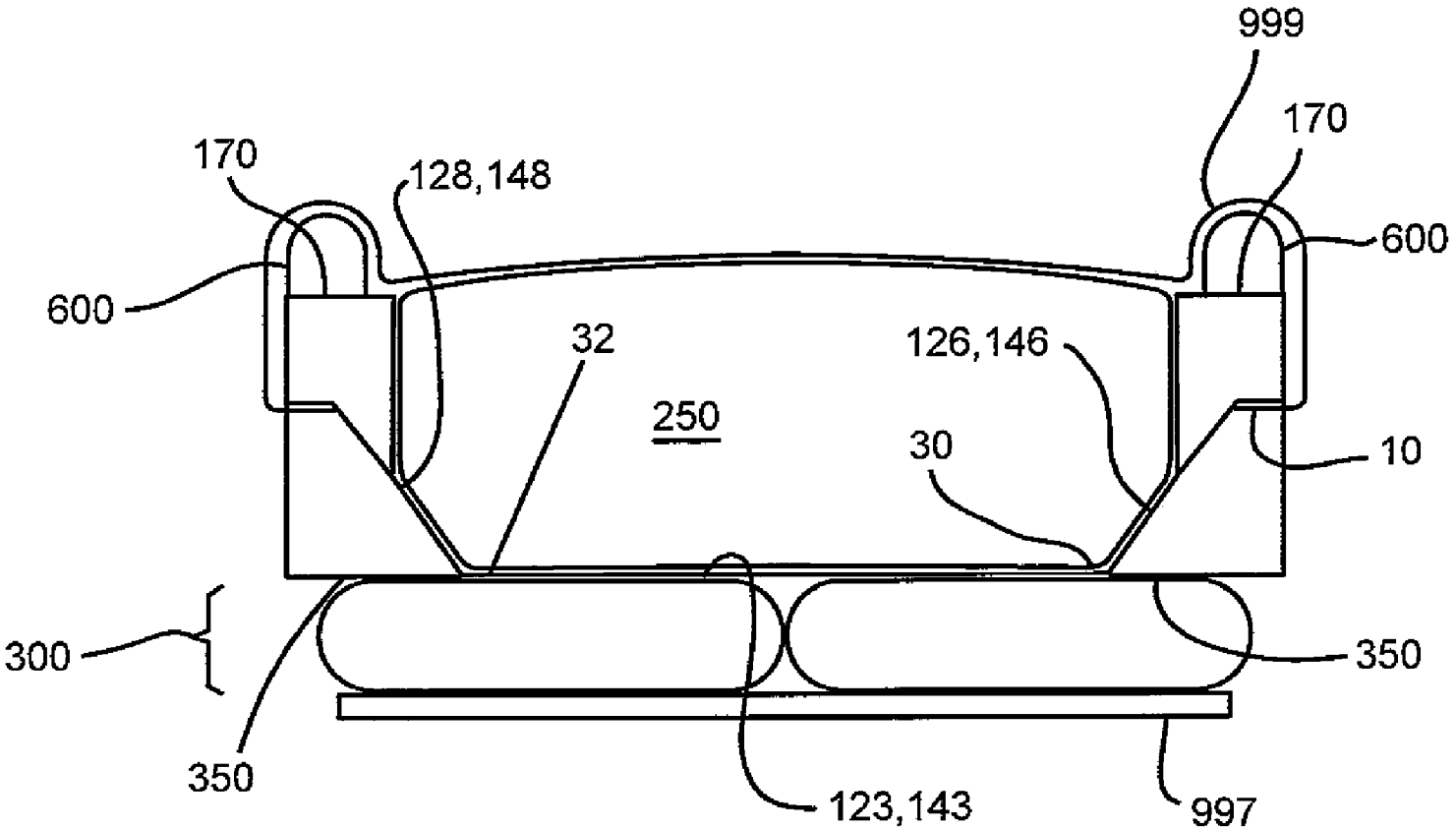
FIG. 10 is an alternative embodiment of FIG. 6 with the sleep deck and the cribbing material.

The preferred embodiment of the longitudinal hinge is described above. The longitudinal hinges 30, 32 can also be for patentability purposes slits and mechanical hinges (metal, rods, pivot hinges and equivalents thereof) especially when the rotating bladders 300 are positioned below the sleeping deck 10 as shown in FIG. 10.

In the latter embodiment, the sleeping deck 10 has lateral supports 350, normally foam, extending from the base area 123 and 143 that extend toward a point that is vertical (or about vertical) from the ledge 129 of head walls 126,128,146, 148, and hinges 30, 32 that are positioned at or near (a) the respective right and left junctures between the base area 123, 143 and the head walls 126, 128, 146, 148 for contoured sleep decks and (b) the respective right and left sides of planar sleeping decks. This embodiment can be positioned over a planar surface or a second gatching sleep surface 997. As previously stated, the slit embodiment and, obviously, the mechanical hinge embodiments do not decrease the shear pressure like the preferred embodiment since there is no fourth cushion material 752.

Passive Restraint

To further decrease the chance of a patient falling off the cushions 250 and/or foam 170, the mattress can have a passive restraint 600. The passive restraint 600 can be positioned entirely along or partially along the cushions 250 right and left side edges as illustrated in FIG. 10. The passive restraint 600 can be foam, gelastic material, a fluid (air or water) contained within a fluid-impervious material, or combinations thereof.

The passive restraint material 600 can be permanently attached to the mattress, fluidly interconnected to the mattress, detachably connected to the mattress, or combinations thereof.

Self-Contained Mattress

The self-contained mattress configuration is obtained when the control box 272, the air bladders 250, the foam cushions 170 (which are optional as illustrated at FIGS. 6 to 9), the conduit distribution unit 530, and the conduits from the control box to the air bladders are all positioned on and/or above the sleep deck's top surface. In addition, a cover 999 can enclose the control box 272, the air bladders 250, the conduit distribution unit 530, the conduits, and optionally the rotation bladders 300 and the sleep deck 10. The cover 999 can be made of natural fibers, polymeric fibers, MERSA resistant fibers, and combinations thereof.

It is intended that the above description of the preferred embodiments of the structure of the present invention and the description of its operation are but one or two enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

We claim:

1. A self-contained gatching mattress comprising:

a gatching mattress sleep deck having a deck head end, a deck foot end, a deck right side, a deck left side, a deck top surface, a head section, a seat section, and a foot section;

a first air bladder cushion (a) positioned above the head section, and (b) has a first top surface, a first bottom surface, a first head end, a first foot end, a first left side, and a first right side;

a second cushion material (a) positioned above the seat section, and (b) has a second top surface, a second bottom surface, a second head end, a second foot end, a second left side, and a second right side;

a control box (a) positioned on the foot section's foot end and on the deck top surface, (b) having an air pump system that draws ambient air into the control box, (c) having a manifold receive the air from the air pump system and direct the appropriate amount of fluid through a first conduit to the first air bladder to allow the first air bladder contain a first desired air pressure;

a conduit distribution unit positioned (a) at or near the juncture between the foot section and the seat section and (b) on the deck top surface, and (c) having a first aperture for the first conduit;

a sliding bridge having a proximal end interconnected to or near the conduit distribution unit and a distal end positioned on top of the control box to form a gap area positioned between (a) the conduit distribution unit and the control box and (b) the foot section and the sliding bridge; and a first cushion material positioned above the sliding bridge and the control box.

2. The self-contained gatching mattress of claim 1 wherein the first conduit, which extends toward the seat section after passing through the conduit distribution unit and the gap area, is positioned (a) within a flexible fabric material having a flexible stiffener that retains an opening larger than the first conduit's outer perimeter, and (b) along (i) the first right side and the second right side or (ii) the first left side and the second left side to avoid increasing the tissue interface pressure and decrease kinking.

3. The self-contained gatching mattress of claim 1 wherein (A) the second cushion material is a second air bladder cushion, (B) the manifold directs the appropriate amount of fluid through a second conduit to the second air bladder to allow the second air bladder to contain a second desired air pressure, (C) the conduit distribution unit has a second aperture for the second conduit and (D) the second conduit, which extends toward the seat section after passing through the conduit distribution unit, is positioned (i) within a flexible fabric material having a flexible stiffener that retains an opening larger than the second conduit's outer perimeter, and (ii) along (a) the second right side or (b) the second left side to avoid increasing the tissue interface pressure and decrease kinking.

4. The self-contained gatching mattress of claim 1 wherein the gatching mattress sleep deck has (a) a first longitudinal hinge (i) extending from the deck head end toward the deck foot end, and (ii) is parallel to and near the deck right side, and (b) a second longitudinal hinge (i) extending from the deck head end toward the deck foot end, (ii) is parallel to and near the deck left side, and (iii) that is not the first longitudinal hinge; and further comprising a rotating bladder positioned below the head section, having a right bladder and a left bladder, the right bladder and the left bladder are interconnected to the manifold;

wherein when the gatching mattress sleep deck is rotated by having the right rotatable bladder raise the right side above the left side, the self-contained gatching mattress' fulcrum point is at the second longitudinal hinge and wherein when the gatching mattress sleep deck is rotated by having the left rotatable bladder raise the left side above the right side, the self-contained gatching mattress' fulcrum point is at the first longitudinal hinge.

5. The self-contained gatching mattress of claim 1 wherein the first air bladder has (a) a first longitudinal hinge (i) extending from the first head end toward the deck foot end, and (ii) is parallel to and near the first right side, and (b) a second longitudinal hinge (i) extending from the first head end toward the deck foot end, (ii) is parallel to and near the first left side, and (iii) that is not the first longitudinal hinge; and further comprising a rotating bladder positioned below the first air bladder, having a right bladder and a left bladder, the right bladder and the left bladder are interconnected to the manifold;

wherein when the first air bladder is rotated by having the right rotatable bladder raise the right side above the left side, the first air bladder's fulcrum point is at the second longitudinal hinge and wherein when the first air bladder is rotated by having the left rotatable bladder raise the left side above the right side, the first air bladder's fulcrum point is at the first longitudinal hinge.

6. The self-contained gatching mattress of claim 5 wherein the first longitudinal hinge has a first shaped aperture having a second cushion material positioned in the first shaped aperture; and the second longitudinal hinge has a second shaped aperture having the second cushion material positioned in the second shaped aperture.

7. The self-contained gatching mattress of claim 1 wherein the gatching mattress sleep deck is a contoured and an adjustably positionable mattress sleep deck with the foot section being retractable and extendable.

8. A self-contained gatching, retractable/extendable foot section mattress comprising:

a gatching mattress sleep deck having a deck head end, a deck foot end, a deck right side, a deck left side, a deck top surface, a head section, a seat section, and a retractable/extendable foot section;

a first air bladder cushion (a) positioned above the head section and on the deck top surface, and (b) has a first top surface, a first bottom surface, a first head end, a first foot end, a first left side, and a first right side;

a second cushion material (a) positioned above the seat section, and (b) has a second top surface, a second bottom surface, a second head end, a second foot end, a second left side, and a second right side;

a control box (a) positioned at the foot section's foot end, (b) having an air pump system that draws ambient air into the control box, (c) having a manifold receive the air from the air pump system and direct the appropriate amount of fluid through a first conduit to the first air bladder to allow the first air bladder contain a first desired air pressure;

a conduit distribution unit (a) at or near the juncture between the foot section and the seat section and (b) on the deck top surface, and (c) having a first aperture for the first conduit;

a sliding bridge having a proximal end interconnected to or near the conduit distribution unit and a distal end positioned on top of the control box to form a gap area positioned between (a) the conduit distribution unit and the control box and (b) the foot section and the sliding bridge; and a compressible first cushion material positioned above the sliding bridge and the control box.

9. The self-contained gatching mattress of claim 8 wherein the first conduit, which extends toward the seat section after passing through the conduit distribution unit and the gap area, is positioned (a) within a flexible fabric material having a flexible stiffener that retains an opening larger than the first conduit's outer perimeter, and (b) along (i) the first right side and the second right side or (ii) the first left side and the second left side to avoid increasing the tissue interface pressure and decrease kinking.

10. The self-contained gatching mattress of claim 8 wherein (A) the second cushion material is a second air bladder cushion, (B) the manifold directs the appropriate amount of fluid through a second conduit to the second air bladder to allow the second air bladder contain a second desired air pressure, (C) the conduit distribution unit has a second aperture for the second conduit and (D) the second conduit, which extends toward the seat section after passing through the conduit distribution unit, is positioned (i) within a flexible fabric material having a flexible stiffener that retains an opening larger than the second conduit's outer perimeter, and (ii) along (a) the second right side or (b) the second left side to avoid increasing the tissue interface pressure and decrease kinking.

11. The self-contained gatching mattress of claim 8 wherein the gatching mattress sleep deck has (a) a first longitudinal hinge (i) extending from the deck head end toward the deck foot end, and (ii) is parallel to and near the deck right side, and (b) a second longitudinal hinge (i) extending from the deck head end toward the deck foot end, (ii) is parallel to and near the deck left side, and (iii) that is not the first longitudinal hinge; and further comprising a rotating bladder positioned below the head section, having a right bladder and a left bladder, the right bladder and the left bladder are interconnected to the manifold;

wherein when the gatching mattress sleep deck is rotated by having the right rotatable bladder raise the right side above the left side, the self-contained gatching mattress' fulcrum point is at the second longitudinal hinge and wherein when the gatching mattress sleep deck is rotated by having the left rotatable bladder raise the left side above the right side, the self-contained gatching mattress' fulcrum point is at the first longitudinal hinge.

12. The self-contained gatching mattress of claim 8 wherein the first air bladder has (a) a first longitudinal hinge (i) extending from the first head end toward the deck foot end, and (ii) is parallel to and near the first right side, and (b) a second longitudinal hinge (i) extending from the first head end toward the deck foot end, (ii) is parallel to and near the first left side, and (iii) that is not the first longitudinal hinge; and further comprising a rotating bladder positioned below the first air bladder, having a right bladder and a left bladder, the right bladder and the left bladder are interconnected to the manifold;

wherein when the first air bladder is rotated by having the right rotatable bladder raise the right side above the left side, the first air bladder's fulcrum point is at the second longitudinal hinge and wherein when the first air bladder is rotated by having the left rotatable bladder raise the left side above the right side, the first air bladder's fulcrum point is at the first longitudinal hinge.

13. The self-contained gatching mattress of claim 12 wherein the first longitudinal hinge has a first shaped aperture having a second cushion material positioned in the first shaped aperture; and the second longitudinal hinge has a second shaped aperture having the second cushion material positioned in the second shaped aperture.

14. The self-contained gatching mattress of claim 8 wherein the gatching mattress sleep deck is a contoured and adjustably positionable mattress sleep deck.

15. A self-contained gatching mattress comprising:

a gatching, contoured, and adjustably positionable mattress sleep deck (a) positioned over a second surface selected from the group consisting of a planar surface or a second gatching sleep surface, and (b) having a deck head end, a deck foot end, a right head wall, a left head wall, a base area, a deck right base side, a deck left base side, a deck top surface, a head section, a seat section, a retractable/extendable foot section;

a first longitudinal hinge (i) extending from the deck head end toward the deck foot end, and (ii) is parallel to and near the deck right base side in the base area, and a second longitudinal hinge (i) extending from the deck head end toward the deck foot end, (ii) is parallel to and near the deck left base side in the base area, and (iii) that is not the first longitudinal hinge;

a first support member positioned below and contacting the left head wall and a second support member positioned below and contacting the right head wall;

a first air bladder cushion (a) positioned above the head section and on the deck top surface, and (b) has a first top surface, a first bottom surface, a first head end, a first foot end, a first left side, and a first right side;

a second cushion material (a) positioned above the seat section, and (b) has a second top surface, a second bottom surface, a second head end, a second foot end, a second left side, and a second right side;

a control box (a) positioned at the foot section's foot end, (b) having an air pump system that draws ambient air into the control box, (c) having a manifold receive the air from the air pump system and direct the appropriate amount of fluid through a first conduit to the first air bladder to allow the first air bladder contain a first desired air pressure;

a conduit distribution unit (a) at or near the juncture between the foot section and the seat section and (b) on the deck top surface, and (c) having a first aperture for the first conduit;

a sliding bridge having a proximal end interconnected to or near the conduit distribution unit and a distal end positioned on top of the control box to form a gap area positioned between (a) the conduit distribution unit and the control box and (b) the foot section and the sliding bridge;

a first cushion material positioned above the sliding bridge and the control box;

a rotating bladder positioned below the head section, having a right bladder and a left bladder, the right bladder and the left bladder are interconnected to the manifold;

wherein when the gatching mattress sleep deck is rotated by having the right rotatable bladder raise the right side above the left side, the self-contained gatching mattress' fulcrum point is at the second longitudinal hinge and wherein when the gatching mattress sleep deck is rotated by having the left rotatable bladder raise the left side above the right side, the self-contained gatching mattress, fulcrum point is at the first longitudinal hinge.

* * * * *